US006801744B2

(12) United States Patent
Fujiwara et al.

(10) Patent No.: US 6,801,744 B2
(45) Date of Patent: Oct. 5, 2004

(54) IMAGE FIXING DEVICE AND IMAGE FORMING DEVICE HAVING LOW FRICTION AND LOW ABRASION CHARACTERISTICS

(75) Inventors: Hidehiko Fujiwara, Tokyo (JP); Masahiko Kamijoh, Kanagawa (JP); Kohta Takenaka, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 10/309,206

(22) Filed: Dec. 4, 2002

(65) Prior Publication Data

US 2003/0103786 A1 Jun. 5, 2003

(30) Foreign Application Priority Data

Dec. 4, 2001 (JP) ..... 2001-369544

(51) Int. Cl.[7] ..... G03G 15/20
(52) U.S. Cl. ..... 399/328
(58) Field of Search ..... 399/328, 333, 399/320, 122; 219/216

(56) References Cited

U.S. PATENT DOCUMENTS

| | | | | |
|---|---|---|---|---|
| 5,058,877 | A | 10/1991 | Fujiwara et al. | |
| 5,298,952 | A | 3/1994 | Kamijo et al. | |
| 5,315,357 | A | 5/1994 | Kamijo et al. | |
| 5,349,425 | A | 9/1994 | Kamijo et al. | |
| 5,985,949 | A * | 11/1999 | Seguchi et al. | 522/5 |
| 6,151,466 | A | 11/2000 | Fujiwara | |
| 2003/0103786 | A1 * | 6/2003 | Fujiwara et al. | 399/328 |

* cited by examiner

*Primary Examiner*—Quana Grainger
(74) *Attorney, Agent, or Firm*—Oblon, Spivak, McClelland, Maier & Neustadt, P.C.

(57) ABSTRACT

An image fixing device a pressure plate that presses against a fixing roller. The pressure plate is made of bridged PTFE or at least coated with bridged PTFE. A heater is provided inside the fixing roller for heating the fixing roller. A paper with a toner image thereon is made to pass through a nipping part formed by the pressure plate and the fixing roller. The image is fixed to the paper by the application of the pressure and the heat.

8 Claims, 2 Drawing Sheets

IMAGE FIXING DEVICE AND IMAGE FORMING DEVICE HAVING LOW FRICTION AND LOW ABRASION CHARACTERISTICS

BACKGROUND OF THE INVENTION

1) Field of the Invention

The present invention relates to an image fixing device that is employed in a multi-function xerograph that serves as a facsimile device, printer, as well as a copier. The present invention also relates to an image forming device that employs the image fixing device.

2) Description of the Related Art

FIG. 3 is a side view of the internal structure of a conventional copier & facsimile device that includes an image forming device that in turn includes an image fixing device. This facsimile device has a main body 1. This main body 1 consists of a removable process cartridge 2 that comprises various process devices for forming color images by xerography. A photoreceptor 3 is provided in the process cartridge 2. There is provided an optical writing device 4 that causes the photoreceptor 3 to scan according to the laser beam that is modulated based on the image data. A paper feed cassette 5 houses the paper (i.e., recording paper) on which the image is to be printed (i.e., recorded). A paper feed roller 6 feeds the paper housed in the paper feed cassette 5. A transfer roller 7 transfers the toner image formed on the recording paper. There is provided an image fixing device 8 that consists of a fixing roller 9 and a pressure roller 10. The image fixing device 8 fixes the toner image to the paper. There are also provided a paper ejection roller 11 that ejects the paper to the outside of the main body 1. There are also provided a contact sensor 12. A draft tray 13 is provided on top of the main body 1 on which a draft that is to be faxed is placed.

Although not shown in FIG. 1, the copier & facsimile device has a communication device that receives image data from other facsimile devices or sends image data to other facsimile devices via a telephone line or the like.

The draft placed on the draft tray 13 is made to go past the contact sensor 12 by a conveyer system and ejected outside of the main body 1. When the draft goes past the contact sensor 12, the image on the draft is optically read by the contact sensor 12. The image data read by the contact sensor 12 or the image data received by the communications device is sent to the optical writing device 4. The optical writing device 4 irradiates the surface of an uniformly charged photoreceptor 3 with a laser beam modulated according to the image data. This causes an electrostatic latent image to be formed on the surface of the photoreceptor 3. The electrostatic latent image is converted to a toner image by fixing the toner. The transfer roller 7 transfers the toner image to the recording paper. The recording papers is then made to pass through the image fixing device 8 where the toner image is fixed to the recording paper by applying heat and pressure. Precisely, recording papers is made to pass through a nipping part formed by the fixing roller 9 and the pressure roller 10image fixing device. The paper ejecting roller 11 ejects the recording paper to the outside of the main body 1.

It is very common to include a fixing roller and a pressure roller in the image fixing device, and provide a fixing heater such as an infra-red heater or a halogen heater in both the fixing roller and the pressure roller. However, the shaft of the pressure roller has a layer of silicon gum, and a parting layer such as a Teflon (registered trademark) tube is laminated above the layer of silicon gum. Therefore, even if the pressure roller has the heater inside it, it does not get heated up as desired. This causes inadequate fixing. There is an added disadvantage in terms of material cost which goes up considerably. Also, high pressure application is required in order to secure a moderate nipping width between the fixing roller and the pressure roller. If pressure higher than the appropriate pressure is applied, it results in stress on the recording paper and causes wrinkles.

There has been research along the lines of fabricating a image fixing device in which, instead of employing a pressure roller, the nipping part is created by pressing a pressure plate against the fixing roller. By virtue of the flat shape of the pressure plate, the heat application is more effective than when the pressure roller is used. This also made the securing of appropriate nipping width possible.

However, it is desirable that the following conditions are satisfied if a pressure plate is employed. These are, the pressure plate should have a low coefficient of friction and should not apply extra load to the paper while the paper is transported, should have a good heat resistance and low thermal expansion, and should have low abrasion loss. One material that has a high heat resistance and low coefficient of friction is fluorocarbon resin. However, the polytetrafluoroethylene (PTFE) in the fluorocarbon resin is inferior to PFA or FEP in mechanical strength, even though PTFE has a lower coefficient of friction than PFA and FEP.

Further, in the conventional image fixing device with the fixing roller and the pressure roller, the force on the paper during conveying can be adjusted as desired. However, this is not possible in the image fixing device with the pressure plate. The result can be jamming of the paper between the fixing roller and the pressure plate.

One solution for reducing the possibility of jamming that was considered was to use PTFE as the pressure plate. However, there does exist friction between the pressure plate and the fixing roller or the paper. This wears the pressure plate and when the abrasion loss becomes sufficiently large, causes tears in the plate, resulting in inadequate fixing. It is also required that the pressure plate should have mechanical strength in order for it to maintain its position against the fixing roller to secure the nipping width or to avoid or not to be damaged when a jam is being released.

SUMMARY OF THE INVENTION

It is an object of the present invention to provide a image fixing device in which the abrasion loss due to friction between the pressure plate and the fixing roller or the paper is substantially reduced.

These and other objects, features and advantages of the present invention are specifically set forth in or will become apparent from the following detailed descriptions of the invention when read in conjunction with the accompanying drawings.

DETAILED DESCRIPTIONS

An embodiment of the present invention will be explained next with reference to the accompanying drawings.

Figure 1:
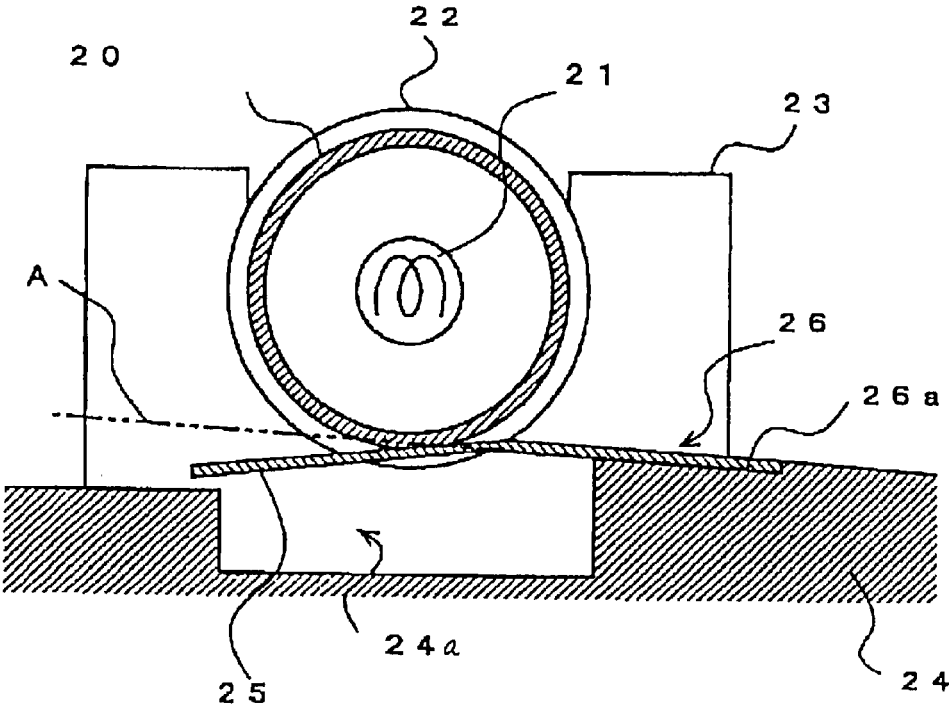
FIG. 1 is a side view of a image fixing device according to an embodiment of the present invention.
Figure 2:
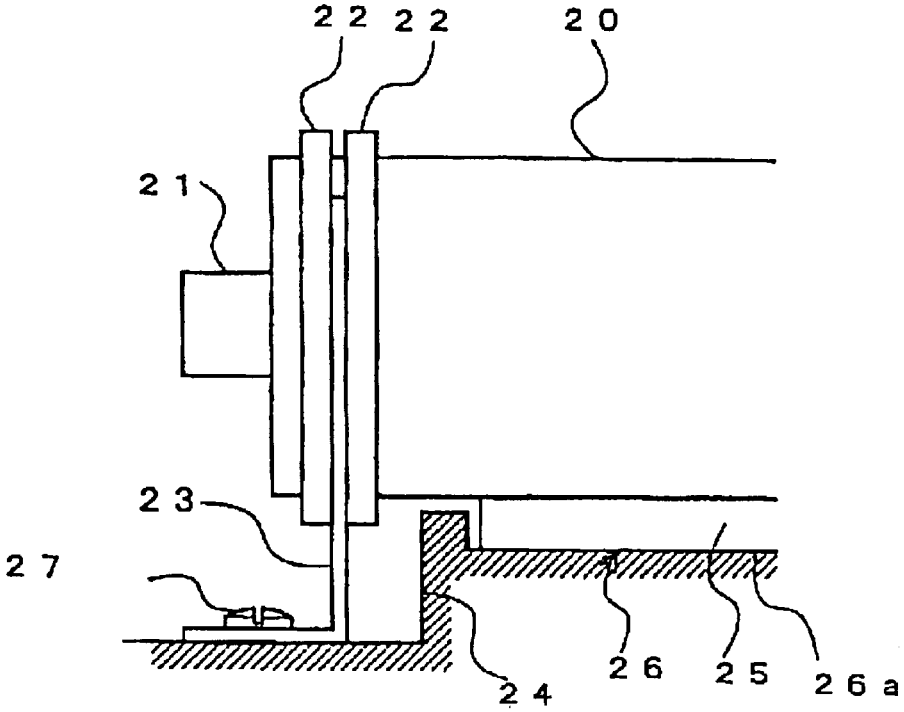
FIG. 2 is the front view of the image fixing device shown in FIG. 1.

FIG. 1 is a side view of an image fixing device according to the embodiment of the present invention. FIG. 2 is the front view of the image fixing device shown in FIG. 1. The reference numeral 20 is a fixing roller, 21 is a heater provided inside the fixing roller 20, 22 is a shaft bearing provided at both ends of the fixing roller 20, 23 is a supporting plate that supports the shaft bearings 22, 24 is a base, 25 is a pressure plate, 26 is an attachment portion where the pressure plate 25 is attached, and 27 is a screw that fixes the supporting plate 23 to the base 24.

The heater 21 is an infra-red heater or a halogen heater.

The pressure plate 25 is made of bridged PTFE. Bridged PTFE is obtained by irradiating polytetraflouroethylene with ionized radioactive beam (γ rays or electron beam) in an environment of inert gas at temperatures close to the fusion/melting point. The coefficient of friction of bridged PTFE is much lower than that of the non-bridged PTFE. Also, bridged PTFE is 1000 to 10000 times more abrasion-resistant than non-bridged PTFE, and hence has a high mechanical strength.

A concave portion 24*a* is provided in the base 24 right below the fixing roller 20. A step-like attachment portion 26 is provided on the edge of the base 26 upstream in the direction of the paper conveyance. A bottom guide that guides the underside of the recording paper from the transfer roller 7 to the fixing roller 20, the concave portion 24*a* and the attachment portion 26 are molded when the mould of the base 24 is prepared.

One end of the pressure plate 25 is secured to the stepped portion of the attachment portion 26 on an attachment surface 26*a* with the help of a pressure-sensitive adhesive double-coated tape. The other end of the pressure plate 25 is free and can move freely in up or down direction.

The supporting plate 23, which is located downstream in the direction of the paper conveyance with respect to the attachment portion 26, is fixed to the base 24 with the help of the screw 27. As shown in FIG. 2, the fixing roller 20 is mounted on the main body of the image forming device with the help of the supporting plate 23 that supports the two shaft bearing 22. The attachment portion 26 is disposed on the base 24 in such a way that the plane on which the attachment surface 26*a* lies cuts the bottom of the fixing roller 20 at an angle. By securing the pressure plate 25 to this attachment portion 26, the pressure plate 25 is made to be disposed along a plane A on which the attachment surface 26*a* lies. Thus, the attachment surface 26*a* is prepared in such a way that the pressure plate 25 is slanting.

When the fixing roller 20 is mounted, this inclination of the pressure plate creates a springiness and allows a pressure contact between the fixing roller 20 and pressure plate 25. The pressure created between the fixing roller 20 and the pressure plate 25 is the nipping pressure. The thickness or the material of the pressure plate 25 determines the springiness of the plate. Hence, the position of the fixing roller 20 may be set, taking into consideration the property of the pressure plate 25, in such a way that the desired nipping pressure is attained. Further, the length of the pressure plate is such that, when the fixing roller 20 is mounted, the free end of the pressure plate 25 almost touches the step portion of the concave portion 24*a* in the downstream direction of the paper conveyance.

In FIG. 1, the free end of the pressure plate 25 is shown to be tipped downward. However, the fixing roller 20 can also be mounted in such a way that the pressure plate 25 is horizontal.

Figure 3:
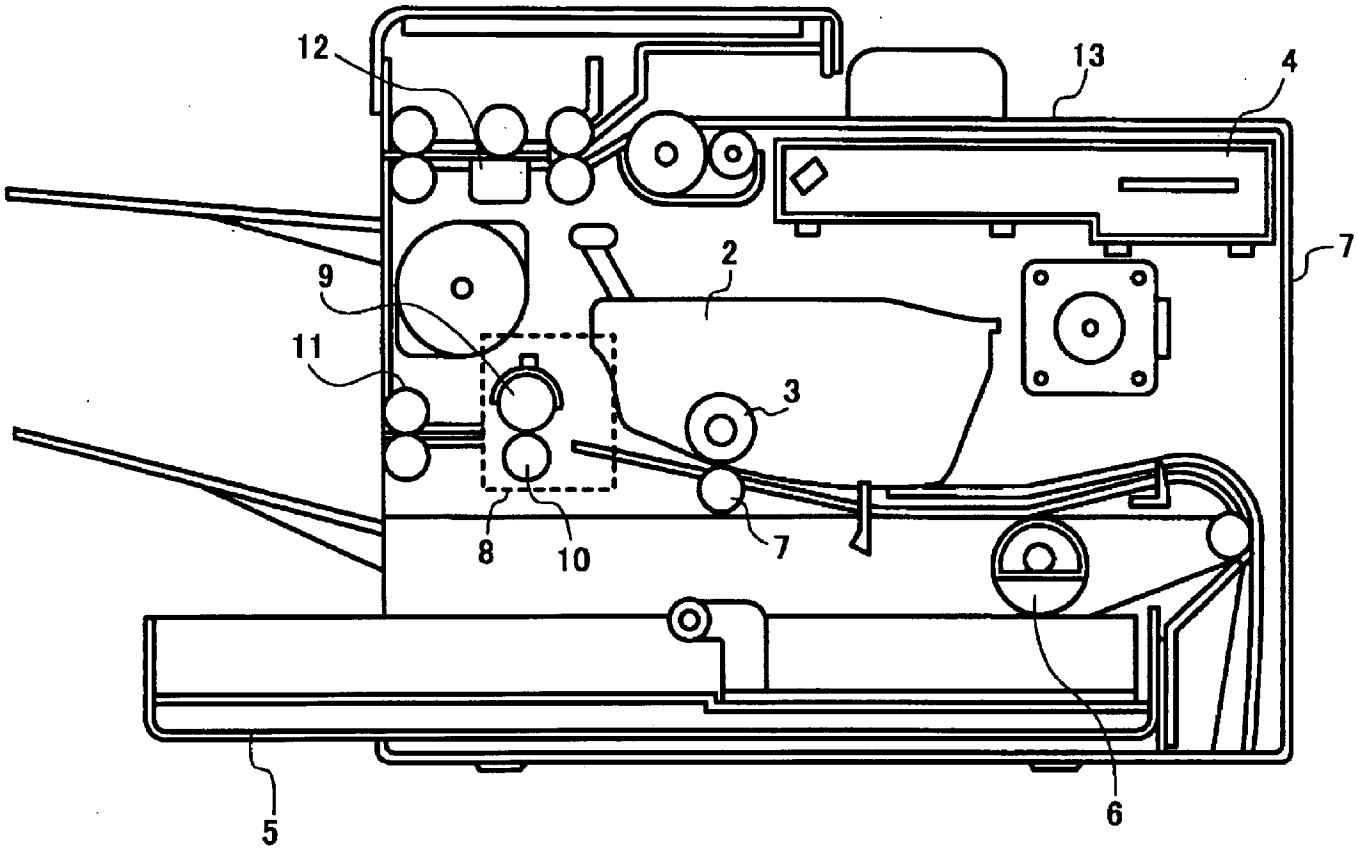
FIG. 3 PRIOR ART
FIG. 3 is the side view of a conventional copier & facsimile device that includes an image forming device and an image fixing device.

The image fixing device 8 shown in FIG. 3 is replaced with the image fixing device shown in FIG. 1 or FIG. 2 to obtain the image forming device according to the present invention.

The degree of abrasion-resistance of the pressure plate in the image fixing device was tested in an experiment conducted under the following conditions,

| | |
|---|---|
| Linear velocity | 64 mm/sec |
| Fixing temperature | 190° C. |
| Fixing roller | Φ20Al shaft |
| Fixing roller surface coating | PFA + C |
| Paper | A4 portrait |
| Image formation mode | 5% character image, continuous copying |
| Pressure plate thickness | 0.3 mm |

When the pressure plate made of the non-bridged PTFE is employed, as in the conventional technology, the plate showed wear at 80,000 sheets. In contrast, when the pressure plate made of the bridged PTFE plate is employed, as in the present embodiment, the plate did not show any wear even at 200,000 sheets and visually too, the abrasion loss was minimal.

Thus, using a bridged PTFE plate assures a long service life and a sustained fixing by the image fixing device. Apart from an excellent abrasion-resistance, bridged PTFE also has transparency. Hence, the optical sensor can be placed on the backside of the pressure plate so that transit of paper can be detected closer to the nipping part.

Bridged PTFE can also be diluted and used as a coating material for coating a heat-resistant base material like fluorocarbon resin or any resin that can withstand the temperatures of the fixing roller. A pressure plate fabricated by such a method can have an equally long service life.

According to the present invention, by making the pressure plate with the bridged PTFE, which has a higher heat-resistance than the non-bridged PTFE, the nipping width can be secured. As a result, the service life of the plate can be prolonged. The efficiency of the image fixing device that employs the pressure plate according to the present invention, which has high thermal efficiency, can be sustained over a long time. Further, since the friction between the paper and the plate is reduced, the load on the paper in the nipping part can be reduced and thus the possibility of jamming of the paper in the nipping part can be reduced.

The present document incorporates by reference the entire contents of Japanese priority document, 2001-369544 filed in Japan on Dec. 4, 2001.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image fixing device that fixes a toner image on a recording medium, the image fixing device comprising:

a fixing roller that rotates freely along a shaft, the fixing roller at least applying heat to the recording medium;

a heater provided inside the fixing roller for heating the fixing roller; and a plate made of heat-resistant base material with a coating of bridged polytetraflouroethylene, the plate having two ends, one end of the plate being fixed at a point that is upstream to the direction of conveyance of the recording medium and the other end pressing against the fixing roller with a spring action.

2. The image fixing device according to claim 1, wherein the heater is an infra-red heater.

3. The image fixing device according to claim 1, wherein the heater is a halogen heater.

4. The image fixing device according to claim 1, wherein the heat-resistant base material is a fluorocarbon resin.

5. An image forming device comprising an image fixing device that fixes a toner image on a recording medium, the image fixing device having a fixing roller that rotates freely along a shaft, the fixing roller at least applying heat to the recording medium;

a heater provided inside the fixing roller for heating the fixing roller; and a plate made of heat-resistant base material with a coating of bridged polytetraflouroethylene, the plate having two ends, one end of the plate being fixed at a point that is upstream to the direction of conveyance of the recording medium and the other end pressing against the fixing roller with a spring action.

6. The image forming device according to claim 5, wherein the heater is an infra-red heater.

7. The image forming device according to claim 5, wherein the heater is a halogen heater.

8. The image forming device according to claim 5, wherein the heat-resistant base material is a fluorocarbon resin.

* * * * *